US010904690B1

(12) United States Patent
Barkai

(10) Patent No.: US 10,904,690 B1
(45) Date of Patent: Jan. 26, 2021

(54) ENERGY AND PHASE CORRELATED AUDIO CHANNELS MIXER

(71) Applicant: NUVOTON TECHNOLOGY CORPORATION, Hsin-chu (TW)

(72) Inventor: Ittai Barkai, Tel Aviv (IL)

(73) Assignee: NUVOTON TECHNOLOGY CORPORATION, Hsin-Chu (TW)

( * ) Notice: Subject to any disclaimer, the term of this patent is extended or adjusted under 35 U.S.C. 154(b) by 0 days.

(21) Appl. No.: 16/714,738

(22) Filed: Dec. 15, 2019

(51) Int. Cl.

| | |
|---|---|
| ***H04R 5/02*** | (2006.01) |
| ***H04S 7/00*** | (2006.01) |
| ***H04S 3/00*** | (2006.01) |
| ***G10L 25/18*** | (2013.01) |

(52) U.S. Cl.
CPC ..... *H04S 7/30* (2013.01); *G10L 25/18* (2013.01); *H04S 3/008* (2013.01); *H04S 2400/01* (2013.01); *H04S 2400/13* (2013.01)

(58) Field of Classification Search
CPC ..... H04S 7/30; H04S 3/008; G10L 25/18
See application file for complete search history.

(56) References Cited

U.S. PATENT DOCUMENTS

| | | | | |
|---|---|---|---|---|
| 4,758,908 | A | 7/1988 | James | |
| 5,796,842 | A | 8/1998 | Hanna | |
| 5,982,447 | A | 11/1999 | Nakamura | |
| 6,590,426 | B2 | 7/2003 | Perrott | |
| 7,212,872 | B1 | 5/2007 | Smith et al. | |
| 7,283,634 | B2 | 10/2007 | Smith | |
| 7,522,733 | B2 | 4/2009 | Kraemer et al. | |
| 8,391,507 | B2 | 3/2013 | Chan et al. | |
| 9,071,214 | B2 | 6/2015 | Thomsen et al. | |
| 2010/0183155 | A1* | 7/2010 | Kim | H04S 3/02 381/17 |
| 2011/0261968 | A1* | 10/2011 | Yu | H03G 3/3005 381/17 |
| 2015/0146889 | A1* | 5/2015 | Hetherington | H03G 3/00 381/119 |
| 2019/0222937 | A1* | 7/2019 | Takagishi | H03G 3/007 |
| 2020/0162817 | A1* | 5/2020 | Neoran | H04R 5/04 |

FOREIGN PATENT DOCUMENTS

| | | | |
|---|---|---|---|
| GB | 394925 | A | 7/1933 |

* cited by examiner

*Primary Examiner* — Simon King
(74) *Attorney, Agent, or Firm* — Kligler & Associates Patent Attorneys Ltd

(57) ABSTRACT

An audio processing apparatus includes an interface, a control processor, an adjustment processor, channel modifiers, and a channel combiner. The interface is configured to receive audio channels including respective audio signals. The control processor is configured to generate a control signal from the audio signals. The adjustment processor is configured to calculate, based on the control signal, an adjusting parameter to an amplitude of at least one of the audio signals. The channel modifiers are configured to, using the adjusting parameter, adjust the audio signals in the respective audio channels. The channel combiner is configured to sum the audio channels after at least one channel has been adjusted, and output the summed audio channel to a user.

20 Claims, 2 Drawing Sheets

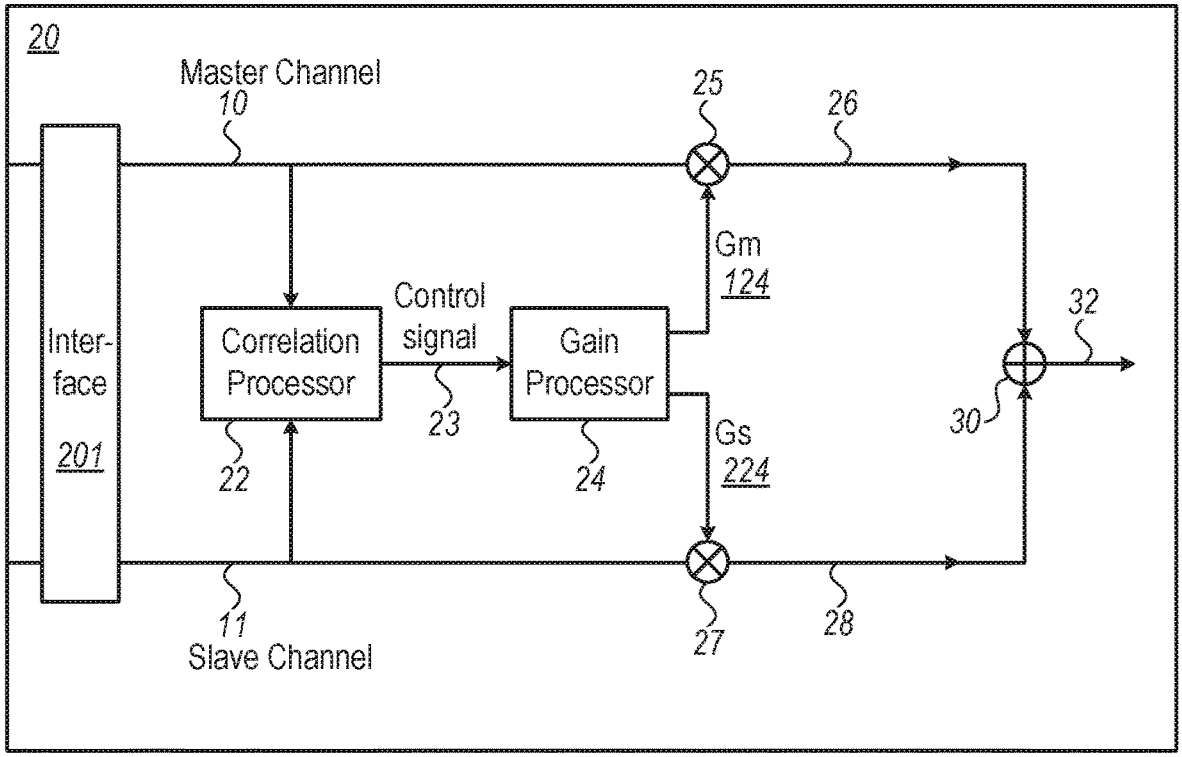
FIG. 1
FIG. 2
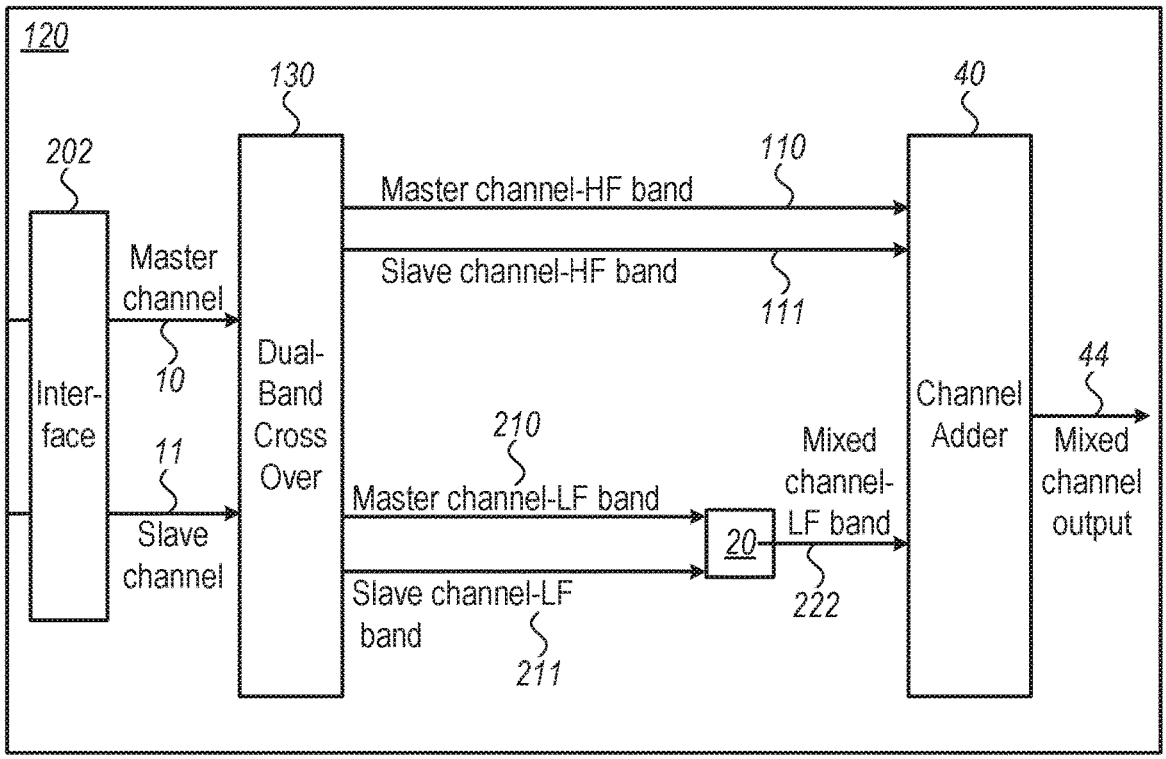

ENERGY AND PHASE CORRELATED AUDIO CHANNELS MIXER

FIELD OF THE INVENTION

The present invention relates generally to processing of audio signals, and particularly to methods, systems and software for generation of mixed audio output.

BACKGROUND OF THE INVENTION

Techniques for mixing of audio channels have been previously proposed in the patent literature. For example, U.S. Pat. No. 7,522,733 describes reproduction of stereophonic audio information over a single speaker that requires summing multiple stereo channels. When signals having approximately equal magnitudes and approximately opposite phases at a frequency are added together, the audio information at the frequency is lost. To preserve areas of potential cancellation and potential audio information loss, the audio enhancement system adjusts the phase relationship between the stereophonic channels. To avoid the loss of the spatial content of the stereo signal, the audio enhancement system determines the difference information that exists between different stereophonic channels. The audio enhancement system enhances the difference information and mixes the enhanced difference information with the phase adjusted signals to generate an enhanced monophonic output.

As another example, U.S. Pat. No. 7,212,872 describes a multichannel audio format that provides a truly discrete as well as a backward compatible mix for surround-sound, front or other discrete audio channels in cinema, home theater, or music environments. The additional discrete audio signals are mixed with the existing discrete audio channels into a predetermined format such as the 5.1 audio format. In addition, these additional discrete audio channels are encoded and appended to the predetermined format as extension bits in the bitstream. The existing base of multichannel decoders can be used in combination with a mix decoder to reproduce truly discrete N.1 multichannel audio.

U.S. Pat. No. 7,283,634 describes a method of mixing audio channels that is effective at rebalancing the audio without introducing unwanted artifacts or overly softening the discrete presentation of the original audio. This is accomplished between any two or more input channels by processing the audio channels to generate one or more "correlated" audio signals for each pair of input channels. The in-phase correlated signal representing content in both channels that is the same or very similar with little or no phase or time delay is mixed with the input channels. The disclosed approach may also generate an out-of-phase correlated signal (same or similar signals with appreciable time or phase delay) that is typically discarded and a pair of independent signals (signals not present in the other input channel) that may be mixed with the input channels. The provision of both the in-phase correlated signal and the pair of independent signals makes the present approach also well suited for the downmixing of audio channels.

Other solutions for mixing two signals were proposed in the patent literature. A solution using a Phase locked Loop (PLL) circuit (described for instance in U.S. Pat. No. 6,590,426) may detect a phase as a means of correcting it. In the case of music signals, the two (or more) signals might not be exactly the same, as they might not share the same phase or even the same frequency and correcting or aligning the phase of one channel to that of the other or that of a reference or target may not produce a desired result.

SUMMARY OF THE INVENTION

An embodiment of the present invention provides an audio processing apparatus including an interface, a control processor, an adjustment processor, channel modifiers, and a channel combiner. The interface is configured to receive audio channels including respective audio signals. The control processor is configured to generate a control signal from the audio signals. The adjustment processor is configured to calculate, based on the control signal, an adjusting parameter to an amplitude of at least one of the audio signals. The channel modifiers are configured to, using the adjusting parameter, adjust the audio signals in the respective audio channels. The channel combiner is configured to sum the audio channels after at least one channel has been adjusted, and output the summed audio channel to a user.

In some embodiments, the control processor is configured to generate the control signal as a function of a ratio of an output signal amplitude of the control processor to an amplitude of one of the audio signals, wherein the ratio is indicative of a phase difference between the audio signals. In some embodiments, the ratio is time-dependent.

In an embodiment, the audio signals, the control signal, and the adjusting parameter are all time-dependent.

In another embodiment, the control signal includes a correlation coefficient between the audio signals, and wherein the control processor is configured to generate the correlation coefficient by cross-correlating the audio signals.

In some embodiments, the control processor is configured to assign the correlation coefficient values that vary between +1 and 0. In other embodiments, the control processor is configured to assign the correlation coefficient values of +1 or −1.

In an embodiment, the audio channels are mono channels. In another embodiment, at least one of the audio channels is a stereo channel.

In some embodiments, the channel modifiers include scalar multipliers.

In some embodiments, the apparatus further includes a multi-band crossover, which is configured to split the audio signals of each of the audio channels into spectral bands, and to provide one or more pairs of respective spectral bands having same frequencies to the control processor for generating a respective control signal for each of the pairs.

There is additionally provided, in accordance with another embodiment of the present invention, a method, including receiving audio channels including respective audio signals. A control signal is generated from the audio signals. Based on the control signal, an adjusting parameter is calculated to an amplitude of at least one of the audio signals. Using the adjusting parameter, the audio signals in the respective audio channels are adjusted. The audio channels are summed after at least one channel has been adjusted, and outputting the summed audio channel to a user.

In some embodiments, the method further includes splitting the audio signals of each of the audio channels into spectral bands so as to produce one or more pairs of respective spectral bands having same frequencies, wherein generating the control signal includes generating a respective control signal for each of the pairs.

The present invention will be more fully understood from the following detailed description of the embodiments thereof, taken together with the drawings in which:

BRIEF DESCRIPTION OF THE DRAWINGS

FIG. 1 is a schematic block diagram of an audio processing apparatus, in accordance with an embodiment of the present invention;

FIG. 2 is a schematic block diagram of an audio processing apparatus further comprising a dual-band crossover, in accordance with an embodiment of the present invention;

DETAILED DESCRIPTION OF EMBODIMENTS

Overview

Figure 3:
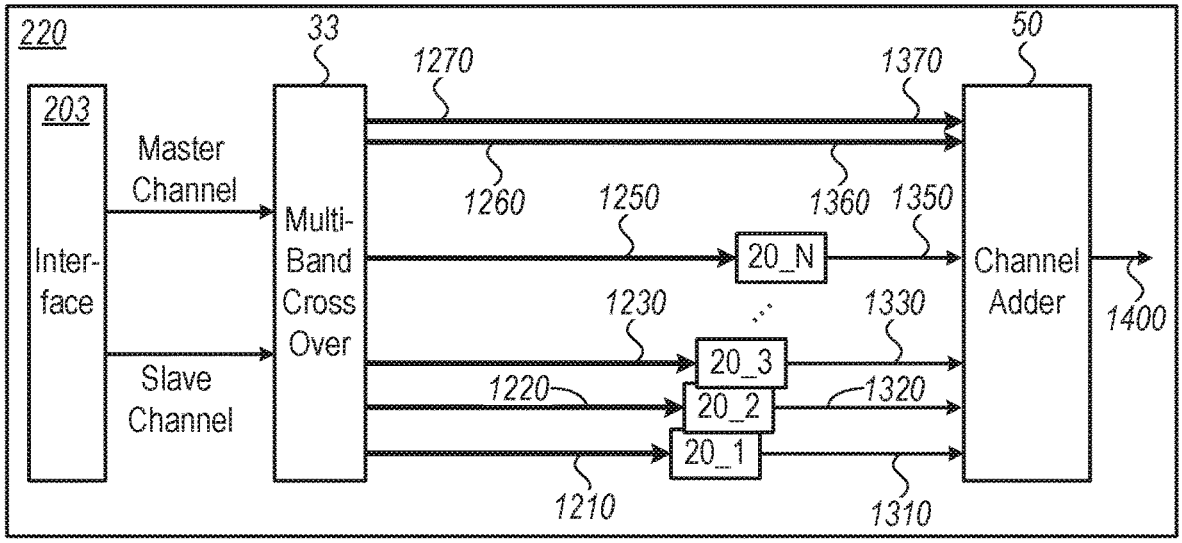
FIG. 3 is a schematic block diagram of an audio processing apparatus further comprising a multi-band crossover, in accordance with an embodiment of the present invention.

In the field of audio processing, mixing two or more channels (i.e., adding two or more channels into one) is a basic technique commonly used by recording engineers, live or radio DJs, music producers, musicians, auto-DJ software, a plethora of music applications (digital music player applications), and others. The result of mixing, which often only involves a simple mathematical operand, might not always produce the expected output.

For example, adding two mono channels with similar or identical content (e.g., amplitude and frequency) although phase-shifted by 180°, actually subtracts the two channels instead of adding them, which is far from the expected result. Subtracting the two channels causes energy and information loss irreversibly, while the intended addition would have provided more energy and more information, combined. If only some of one channel's content is phase-shifted by 180° relative to the other channel, adding the two channels leads to at least a partial loss of information and energy.

Embodiments of the present invention that are described hereinafter provide audio processing apparatuses and methods that automatically predict and/or detect imminent partial- or full-energy and information loss upon mixing various channel types (e.g., mixing mono channels, mixing stereo channels into a single stereophonic (two channel) output, mixing two "full stereo tracks," defined below, into a single stereophonic output channel) to substantially avoid these losses while mixing two or more audio channels.

In some embodiments, two audio channels are provided, each comprising time-dependent audio signals. An interface of the audio processing apparatus receives the audio signals. A control processor derives, using the two audio channel signals, a typically time-dependent respective control signal, such as a control signal that depends on a respective time-dependent phase difference between signals from the two audio channels. An adjustment processor (also referred to as gain processor) calculates, using the control signal, an adjusting parameter to an amplitude of at least one of the audio signals. Then, a channel modifier component adjusts, using the adjusting parameter, the audio signals of the channel. Finally, a channel combiner sums (i.e., mixes) the two audio channels (after at least one channel has been adjusted), and outputs the summed audio channel to a user.

An example of a control signal (e.g., parameter) is a coefficient of correlation between the two audio channel signals. An example of an adjusting parameter is a level of gain used to modify a channel.

While the above description considers two channels for simplicity, embodiments of the present invention hold for multiple input channels. The disclosed audio processing apparatuses can mix both analog (continuous) and digital (time-discrete and finite-resolution) signals.

In many cases one channel carries information which is regarded as more important than the other channel(s). This can be based on a human user's artistic decision or be automatically pre-configured based on a criterion, such as "the channel with more energy is more important." For simplicity the more important channel is called hereinafter the "master channel" and the other (s) are referred to as "slave channels(s)." For clarity, a few selected modes of operation are described below, using the master and slave terminology, which highlight various parts of the disclosed technique. Such modes are just a few suggested embodiments of the invention and are brought as non-limiting examples.

A first mode, which is a very common scenario in recording studios, is named hereinafter "Mode_A," in which the audio processing apparatus keeps the signal purity of the master channel high, in a way of minimal interference with the signals. Typically, the audio processing apparatus keeps the adjusting parameter (e.g., gain) of this channel a constant "+1" (no gain value change, no phase reversal). With the slave channel, the audio processing apparatus applying Mode_A may run deeper alterations. For example, and for one specific embodiment of the invention, the audio processing apparatus uses the gain value of the slave channel as the control signal, and attenuates the gain of the slave channel according to a phase difference between audio signals of the master and slave channels, to respectively attenuate the output power of the slave channel.

In Mode_A, as the phase difference between the two signals becomes closer to 180°, the gain of the slave channel becomes lower. Values of such a gain coefficient can be described by a monotonically decreasing function of the relative phase within the interval [0, 180° ], and range within the interval [0, 1], as further described below. As evident, if the slave signal is in complete anti-phase relative to the master signal, the interfering (slave) signal is silenced, and only the master signal is output. The result is a pure signal which is not lost.

Another non-limiting example is referred to as "Mode_B," in which the control processor of the audio processing apparatus is hardware-wise configured in the same way as in Mode_A. However, the decision logic of the audio processing apparatus is different. In Mode_B, the audio processing apparatus works in a binary mode, by either refraining from any adjustment of the slave channel, or completely phase reversing the information of the slave channel. For instance, if the control processor outputs a control signal which is zero or close to zero, meaning that the signals cancel each other, the slave channel receives a gain of "−1" (0 dB gain change, but 180° phase reversal), and thus inverts the slave signal, which end up with both signals added, and played together in the expected manner.

Mode_B is intended mainly for cases in which the cause of the phase reversal is not time dependent (or at least varies very slowly), such as a microphone which inverts the phase due to its design or placement. In this case the user only needs to take a single, time-independent decision. Practical systems may be configured to allow a user to select between Mode_A and Mode_B. In particular, in a software implementation, a single system may be provided that is configured to support either Mode_A or Mode_B.

In many practical cases, there are one or more dominant frequency bands that account for the majority of adverse phase-cancellation effects.

In common cases, and especially in electronic dance music, low frequency signals of a given repetitive rhythm (e.g., repetitive bass notes or repetitive low-frequency notes in general) and of equally important channels may be intentionally played "one against the other." In this case, if the original tracks were recorded in inverted phases, or even if there is a slight mismatch or desynchronization between the low-frequency notes of the signals, a partial cancellation of information and loss of energy of low frequency signals will occur.

In this case, temporarily attenuating one of the tracks produces the wrong result, as the intention is to equally mix important low-frequency signals. Therefore, in some embodiments, a mode referred to as "Mode_C" is provided, in which the disclosed audio processing apparatus further comprises a spectral band crossover, which is configured to split the audio signals of the input audio channels into two or more spectral bands, wherein each pair of respective spectral bands from the two audio channels has the same frequencies. A subset of the pairs is treated as a pair of channels, and is further processed with the above or similar type of audio processing apparatuses to perform the following: (a) derive a respective control signal, (b) calculate an adjusting parameter to an amplitude of at least one of the audio signals using at least one channel modifier, and (c) adjust the audio signals of the channel. Finally, using a channel combiner, the adjusted (and non-adjusted, if any) subsets of spectral bands are all summed (i.e., mixed) and the resulting summed audio channel is output to a user.

In one example, a dual-band band crossover is provided to split the input channels into low- and high-frequency bands of, for example, each input stereo channel, wherein the low-frequency signals can be mixed binarily, for example, using Mode_B, while the high-frequency signals can be mixed using Mode_A or left as is.

Embodiments of the present invention provide these methods to avoid information loss due to phase cancellations among more than one channel, without (a) necessarily measuring any phase-difference, (b) explicitly aligning the phase and/or (c) altering the frequencies of the original content on any of the discussed channels. The disclosed embodiments also achieve this in real time and with low computational requirements.

In another embodiment of the present invention, the audio processing apparatus includes a normalizer, which normalizes the two channel inputs (master and slave) ahead of the control processor, so that the control processor derives a control signal for two similar-amplitude signals. In yet another embodiment, a look-ahead buffer is configured to delay the signal itself until after the adjustment processor has calculated the adjusting parameter (e.g., gain). This scheme avoids phase cancellation before it even starts, and without missing a single sample, at the cost of overall increased latency.

Typically, the processors are programmed in software containing particular algorithms that enable the processor to conduct each of the processor-related steps and functions outlined above.

By automatically avoiding loss of energy and information when mixing various types of channels, including mixing different spectral bands, the disclosed technique fills the requirement of providing improved mixing capabilities including maintaining low latency and low computational requirements.

Definitions

The present disclosure uses several terms whose definitions are provided herein:

Mono Channel:

A channel of information (continuous domain or discrete domain representation) with a certain set of information. An example is a recording of a single instrument in a recording studio, e.g. single microphone singer, guitar, etc.

Dual Mono Channel:

Two mono channels of information. The two channels might not be correlated at all.

Stereo Channel:

Two mono audio channels of information, but usually with some correlation. In the common case the content of these two channels is correlated and represents a stereo recording. Playing this content in a correctly set-up audio reproduction system provides a "phantom image." This is sometimes referred to as "Blumlein Stereo" (British patent BP 394,325).

Full Stereo Track:

A specific case of a stereo channel which holds full stereophonic musical content (i.e. recorded song, or track usually holding more than a single instrument). It is most commonly the outcome of mixing and mastering in a recording studio and is the main product of recording companies. This is the common "music file" used and listened to by audiences with, e.g., a CD player, streaming method, and others.

Multi-Channel:

More than two channels combined into a "multi-channel" setup. An example is a surround sound system or a recording in which the channels are separated into Left, Right, Center, Rear-Left, Rear-Right, LFE, etc.

Mixing:

Adding one or two channels into a common output channel. This output might not be single i.e., might be more than one channel.

The simplest and most common case is for two mono channels to be added into one mono channel output.

A more complex, but very common, scenario is mixing two (or more) "full tracks" into a single stereophonic (two channel) output.

"Mixing" can refer to a "single channel," "stereo channel," "multi track channel" or "full track." In the context of the present disclosure, each of these possibilities is referred to as a "channel." Furthermore, the discussed examples are such that channel "a" is mixed with channel "b," i.e. two channels, each in mono configuration. However, embodiments of the disclosed invention cover all other possibilities, including (but not limited to) mixing more than two channels, mixing one mono channel and other stereo (or more) channels, two stereo channels, etc.

Phase:

Phase is a measurable physical dimension, usually expressed in angles (0°-360°) or in Pi (0-2Pi). For this discussion phase is a relative dimension between (at least) two sources of information (channels). This is sometimes referred to, in the art, as "channel phase" or "inter-channel phase."

Phase can be seen as a slight delay between one track and the other for a specific frequency. A full-time delay, sometimes referred to as "latency," would suggest that all frequencies are time delayed in the same amount of time (usually measured in micro-seconds, musical notation, or Beats Per Minute parts). Phase delay, however, can be such that some frequencies are seen as time delayed (between the two channels) while others are not, or are not delayed for the same amount of time, as the first group.

Phase Inverted:

Two channels having the same content are said to be "phase inverted" if there is an 180° phase difference between them. This means that their waveform shows the same exact shape but flipped across the horizontal axis. Adding these two signals into one results in a complete loss of information.

Dry Channel:

This is a recording technique in which the electronic output of the recorded instrument is collected into the recording mixer, being in a digital or analog domain. It is a common recording studio technique to fit an acoustic instrument with a "pickup." The electronic information collected by the "pickup" channel is then referred to as a "dry channel." Examples are acoustic guitars, double bass, etc.

Wet Channel:

This is a recording technique in which the recorded signal is not just that of the instrument (see above) but might carry more information, such as room reverberation (room echo), the sound of the amplifier or speaker of the recorded electric instrument, or any other sound effects that run on this channel.

As an example, a common technique for recording electric bass guitar is to set up the instrument with its accompanying amplifier-speaker placed within the recording studio. One microphone records the acoustic output, not of the instrument itself but of the amplifier-speaker set. This is commonly named the "wet channel."

Another microphone transfers the electronic information of the pickup itself directly to the recording mixer console, and no acoustic information is actually added from the output of the instrument to the recording console. This is commonly named the "dry channel."

The common technique is to mix some of the wet channel with all of the dry channels to receive a new, blended signal which sounds more pleasing.

This recording technique is not limited to bass guitars, but is very common to other instruments. The electric bass guitar example is brought here as a mere example only.

Energy and Phase Correlated Audio Channel Mixer

FIG. 1 is a schematic block diagram of an audio processing apparatus 20, in accordance with an embodiment of the present invention. Apparatus 20, which is configured to apply Mode_A and/or Mode_B of mixing, receives as an input, using an interface 201, two audio channels (10, 11) each comprising time-dependent audio signals. Apparatus 20 can be configured to process either analog or digital signals.

In the shown embodiment, one input channel is configured by a user or system as a master channel (10), and the other input channel is configured as a slave channel (11). For simplicity, channels 10 and 11 are assumed to be mono audio channels. However, this is a non-limiting example used for clarity and simplicity of description.

A control (e.g., correlation) processor 22 receives audio signals from both channels, and derives from the audio signals a time-dependent control signal, for example, by cross-correlating the audio signals from the two audio channels. Correlation processor 22 outputs a respective control signal 23, such as a resulting time-dependent correlation coefficient between the audio signals.

In an embodiment, in Mode_A, a correlation processor outputs a correlation coefficient, C, having the form of:

$$C = \frac{\text{abs}(Ma + Sl)}{\text{abs}(Ma + Sl) + \text{abs}(Ma - Sl)} \quad \text{Eq. 1}$$

wherein Ma is a momentary value (which may be a continuous single sample or a discrete sample) of the master channel, and Sl is a momentary value (which may be a continuous single sample or a discrete sample) of the slave channel.

As seen in Eq. 1, in the disclosed embodiment there is no need to measure a phase difference between the master and slave signals, but only add and/or subtract momentary values of the signals. Eq. 1 is a specific embodiment, and other embodiments to estimate a correlation coefficient without resorting to direct measurements of phases are covered by the disclosed technique. The mathematical function described in Eq. 1 can be expressed in other forms but hold substantially the same mathematical value. In a different embodiment of the invention, more than one control signal might be outputted from correlation processor 22.

The described Mode_A scenario is a realistic application. For example, in a recording session in which the frequency of the slave channel is very closely related to that of the master channel, e.g., acoustic recording of the electric bass guitar, as a non-limiting example, in which slave channel is very closely related to that of the master, pickup, channel, as the notes and musical notation (i.e. frequency) remain similar in the two channels. In this case, looking at limiting cases of Eq. 1 for a few scenarios may assist in better understanding of the disclosed solution.

Under the mentioned scenario, one possible case is where Ma equals Sl (Ma=Sl), meaning that the two channels carry the same or at least very highly correlated signals. In this case the result of Eq. 1 is {C=1}.

Figure 4:
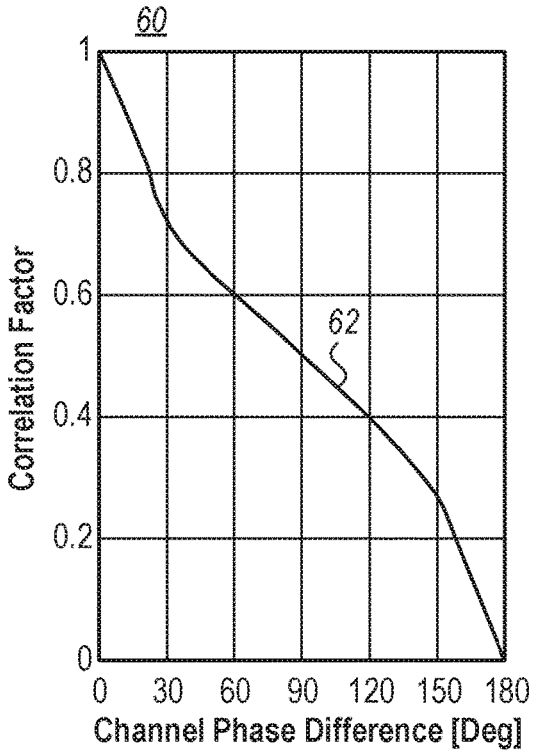
FIG. 4 is a graph showing a measured correlation factor, such as generated by the correlation processor of FIG. 1, as a function of a phase between audio signals, in accordance with an embodiment of the present invention.

In another possible case, Ma equals Sl in amplitude but reversed in phase by exactly 180°. In this case, (Ma=(−Sl)) and {C=0}. For other phase values, a typical correlation factor (i.e., a function) can be presented by a graph, as shown by FIG. 4.

Using the time-dependent control signal (e.g., correlation coefficient, C), an adjustment processor (e.g., gain processor 24) calculates an adjusting parameter to an amplitude of each of the audio signals of channels 10 and 11. In the shown embodiments, the adjusting parameters are gains, and gain processor 24 outputs gain coefficients (Gm(t) 124, Gs(t) 224) to both master channel 10 and slave channel 11.

In some of the embodiments, brought here by way of example, the gain of the master channel, Gm(t) 124, is kept to a constant "+1" (no gain changes at all), while the gain of the slave channel, Gs(t) 224, is varied between "+1" and zero. An example is using a gain value as the correlation coefficient C of Eq. 1.

Where Gs(t) 224 is zero, or close to zero, the slave signal is technically silenced or almost silenced, respectively. Thus, the system outputs the important signal (master) and silences the less important signal (slave) only when the signals would otherwise cancel each other out. The user of this system might momentarily lose the information of the slave signal, but without using the disclosed technique the full signal would have been nulled due to the phase cancellation of both the signals, and all of the information would have been lost, which is the worst outcome.

Next, respective channel modifiers 25 and 27, which, in the shown example, are multipliers by scalars, adjust the audio signals using the respective adjusting parameter (e.g., by multiplying the signals with scalars that are the respective gain coefficients, Gm(t) 124 and Gs(t) 224), to output adjusted audio channels 26 and 28.

Finally, a channel combiner 30, an "add" mixer in FIG. 1, generates an output audio channel 32 by summing the two adjusted audio channels, 26 and 28, and outputting the generated mixed audio channel 32 to a user.

As noted above, Mode_A is a common scenario, in which the recording engineer runs a dry channel from the pickup of an electronic instrument (e.g. electric bass guitar) directly into the recording console. An electro-acoustic microphone is then positioned in front of the electric guitar amplifier-speaker set up within the room. The electronic output of this microphone is also collected by the recording consoles. A common practice is to mix the dry signal with at least a portion of the wet signal in order to receive a more pleasing overall sound. As explained above, if these two channels are momentarily phase reversed, and thus cancel each other out, the outcome is a sudden loss of energy unless the discussed solution is used.

It is worth mentioning that the discussed common recording technique is used with some acoustical instruments as well, such as an acoustic bass or double bass. In this case, the recording engineer might "reverse" the roles of master and slave as presented above, using the pickup channel from the instrument as the slave and the acoustic microphone (or microphones) as the master, while with electronic instruments a common decision is to do the opposite. However, this does not limit the scope to any particular solution in which one channel can be marked by a user (or software) as the master and the other as slave.

In some embodiments, audio processing apparatus 20 is applied in Mode_B, which is another non-limiting usage very common in recording studios. As mentioned above, Mode_B discusses static cases in which the cause of the phase reversal is not time dependent, such as a microphone which inverts the phase due to its design or placement. In this case the system needs to reach a constant decision, not time dependent as well. This is the core difference between Mode_A and Mode_B.

In a real-world audio processing system, it is therefore offered that systems designed with the goal of Mode_B (and not Mode_A) will be time limited and able to reach a single, not changeable decision after the signals are input for the first time. In a specific embodiment such a system could light up an LED or warning that the phase is reversed, allowing the human user to intervene and reverse it by pressing another button to trigger a logic processor (e.g., a same control processor used with Mode_A but with applying binary criterion, or function, rather than a continuously valued function such as correlation) to take action. This can avoid cases where the system flips the phase due to an error or mistake.

In a software implementation a single system which can be configured to support either Mode_A or Mode_B can be considered. The document presents these two modes as different solutions only for the sake of clarity.

In the non-limiting example of Mode_B, correlation processor 22 of apparatus 20 is configured in the same way as in Mode_A, with, however, a different logic decision in the system. In Mode_B, (as in Mode_A) apparatus 20 does not intervene in the gain of master channel 10. However, apparatus 20 phase reverses by 180° the information of slave channel 11. For instance, if the correlation computer outputs a control signal which is "0" or close to "0" (meaning that the signals cancel each other out), the slave channel receives a gain of "−1" (0 dB, but phase reversed) which results in both signals playing together in the expected manner.

In Mode_B a user can alter the logic processor (e.g., same control processor that is a used as a correlation processor 22 in Mode_A, and in Mode_B is operated with a binary function) to output a binary result. As explained above, in Mode_B the expected result is that the slave channel is either inverted (multiplied by (−1) in this embodiment) or left as is (multiplied by 1, in this embodiment). In this case one can materialize this logic by a rule, such as:

$$G_s = \text{sign}(C - 0.5) \qquad \text{Eq. 2}$$

in which "sign" denoted the mathematical function "sign" which is equal to 1 for any positive (or zero) value or equal to (−1) for any negative value. In this case, if the correlation factor C is higher than or equal to 0.5, then $G_s=1$. Otherwise, $G_s$ is equal to (−1) and the phase is reversed by 180°.

An example of Mode_B use is recording a drum set, which is usually done by placing microphones on each drum set element, e.g., one microphone each for bass drum, different toms, snares, hi-hats, percussion, bells, etc. Furthermore, it is a common practice to add two additional microphones to record the ambience of the room (acoustic reverberation) in response to the drum set. It is therefore very common to see recording engineers collect many microphone channels into the recording console and manipulating them to receive the requested sound.

In such a scenario it is very common for one channel to be phase reversed against the other due to, among other reasons, (a) reversed polarity of the recording cables, (b) microphones which are "facing each other" (so that one "pulls in" as a response to an acoustic signal, while the other "pushes out" as a response to the same signal), (c) different microphone manufacturers and design. Typically, in this case, the master signal is a single channel (related to one of the microphones) while there may be more than one slave signal.

The result of this phase cancellation is dramatic and might cancel out some of the frequencies and information in the recording. To reduce the burden of the recording engineer, Mode_B can be used.

Furthermore, in Mode_B the transition is not related to the length of notes or drum hits. This is unlike Mode_A in which the possible values are continuous (between "0" and "1") and the transition is done in relation to the energy of the signals, i.e., relatively fast.

To clarify, the system in Mode_B might point out that one of the channels is phase reversed against the master and hence reverse its phase. However, this is done one time only, regardless of the music signal, as a correction to the manner of the microphone set-up. In Mode_A, however, the gain is designed to change according to the incoming signal and certainly not remain constant after a single change.

Energy and Phase Correlated Audio Channels Mixer with Spectral Splitting

FIG. 2 is a schematic block diagram of an audio processing apparatus 120 comprising a dual-band crossover 130, in accordance with an embodiment of the present invention. Audio processing apparatus 120 can be used, for example, when a dual-band Mode_C mixing is required.

In the shown embodiment, the same master 10 and slave 11 audio channels in FIG. 1 are received, using an interface 202, and inputted into dual-band crossover 130, which splits the incoming signals into high-frequency (HF) respective bands 110 and 111, and respective low-frequency (LF) bands 210 and 211. In this example two bands are shown: HF (high frequency) and LF (low frequency). HF band 110 of master channel 10 is not processed, since it is in the HF domain. Similarly, HF band 111 of slave channel 11 input is not processed since it is in the HF domain.

The LF band 210 of master channel 10 input is inputted into an audio processing apparatus 20. In the shown embodiment, an audio processing apparatus 20 is not processed since it is in the master domain and, as in FIG. 1, apparatus 20 is configured not to alter it in order to maintain high signal purity.

The LF band 211 of slave channel 11 input, on the other hand, is processed such that if it phase-cancels the information in LF band 210, apparatus 20 attenuates LF band 211 prior to it adding the channels together into an output mixed channel LF band 222.

To mix the LF bands, apparatus 20, described in this application, includes the correlation processor, control processor (also referred to as correlation processor or logic processor, depending on its utilization mode) and logic processor to apply Mode_A or Mode_B mixing to generate mixed channel LF band 222.

Finally, mixed output signals of the LF domain are added by channel adder 40 (similarly to how channel combiner 30 adds signals) to the HF signals, and outputs the Mode_C mixed output signals 44 to a user.

Mode_C can handle more complex cases in which the frequency variance as a function of time between the two channels (master and slave) can be higher than those solved by two bands.

FIG. 3 is a schematic block diagram of an audio processing apparatus 220 comprising a multi-band crossover 33, in accordance with an embodiment of the present invention. Audio processing apparatus 220 can be used, for example, when a multi-band Mode_C mixing is required.

In the shown embodiment, a master and a slave audio channels are received, using an interface 203, and inputted into multi-band crossover 33, which spectrally splits the incoming signals into multiple pairs of master and slave bands, such as band pairs 1210, 1220, 1230, . . . 1250, and 1260 and 1270.

As seen, multiple audio processing apparatuses 20_1, 20_2, 20_3, . . . 20_N run in parallel in either Mode_A (with a continuous control signal), or in binary Mode_B. Each of apparatuses 20_1, 20_2, 20_3, . . . 20_N receives a frequency band which is just one zone of the full frequency spectrum (non-limiting example: all frequencies between 100 to 200 Hz). Some frequency bands, such as 1260 and 1270 are not processed, similarly to the HF band of FIG. 2. The different frequency bands can be easily "cut" from the full frequency spectrum by means of (for instance) a BPF (Band Pass Filter).

As such, each of apparatuses 20_1, 20_2, 20_3, . . . 20_N deals with "close" frequencies of input signals and of their respective output signals. As a result, the resolution (e.g., specificity) of each of apparatuses 20_1, 20_2, 20_3, . . . 20_N (correlator, logic) is higher, thereby generating higher quality (e.g., sound purity and amplitude accuracy) of signals 1310, 1320, 1330, . . . 1350, with use of, for example, Mode_A to generate each of the signals 1310, 1320, 1330, . . . 1350.

Finally, mixed output signals of the different band pairs are added by channel adder 50, which outputs the multi-band Mode_C mixed output signals 1400 to a user.

The example illustrations shown in FIGS. 1, 2, and 3 are chosen purely for the sake of conceptual clarity. FIGS. 1-3 show only parts relevant to embodiments of the present invention. For example, other system elements, such as power supply circuitries and user-control-interfaces are omitted.

In various embodiments, the different elements of the audio processing apparatuses shown in FIGS. 1-3 may be implemented using suitable hardware, such as using one or more discrete components, one or more Application-Specific Integrated Circuits (ASICs) and/or one or more Field-Programmable Gate Arrays (FPGAs). Some of the functions of the disclosed audio processing apparatuses, e.g., some or all functions of correlation processor 22 and/or gain processor 24, may be implemented in one or more general-purpose processors, which are programmed in software to carry out the functions described herein. The software may be downloaded to the processors in electronic form, over a network or from a host, for example, or it may, alternatively or additionally, be provided and/or stored on non-transitory tangible media, such as magnetic, optical, or electronic memory FIG. 4 is a graph 60 showing a measured correlation factor 62, such as generated by correlation processor 22 of FIG. 1, as a function of a phase between audio signals, in accordance with an embodiment of the present invention. In some cases, correlation factor 62 equals a gain coefficient of a slave channel, such as gain coefficient Gs(t) 224 of slave channel 11 of FIG. 1.

As seen, correlation factor 62 is a monotonically decreasing function from +1 to zero, of the relative phase between the signals within [0, 180]. The graph of correlation factor 62 is based on real-time measurements of sine wave signals at 80 Hz and the dependence on phase difference between the signals is not explicitly given. The embodiment given in Eq. 1 is a brought here as a none-limiting example.

Figure 5:
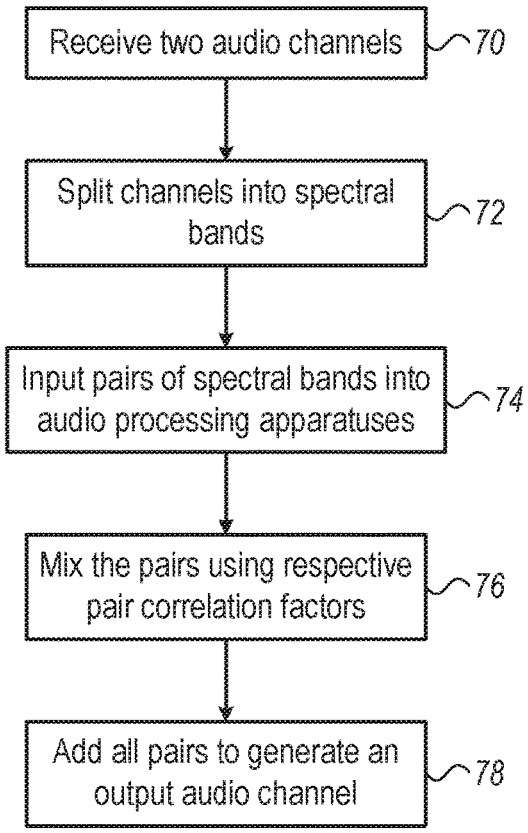
FIG. 5 is a flow chart that schematically illustrates a method of mixing two audio channels using the audio processing apparatus of FIG. 3, in accordance with an embodiment of the present invention.

FIG. 5 is a flow chart that schematically illustrates a method of mixing two audio channels using audio processing apparatus 220 of FIG. 3, in accordance with an embodiment of the present invention. The algorithm, according to the presented embodiment, carries out a process that begins with multi-band crossover 33 receiving a master and slave channels as an input, at a receiving audio channel inputs step 70. Next, multi-band crossover 33 splits the input channels into respective spectral pair-band signals, at a channel spectral splitting step 72. At least a portion of the multiple pair-band signals is inputted into respective multiple audio processing apparatuses, at spectral band inputting step 74. The multiple audio processing apparatuses each produce a mixed spectral signal, e.g., using Mode_A, at a spectral band mixing step 76. Finally, at an outputting step 78, an adder such as channel adder 50, sums the mixed spectral signals and outputs the resulting signal to a user.

Although the embodiments described herein mainly address audio processing in environments such as recording studios, the methods and systems described herein can also be used in other applications, such as in processing of multiple audio channels in mobile communication and computing devices such as smartphones and mobile computers. For example, most cellular phone devices are monophonic devices and play music via a single speaker even though most music content (YouTube, streaming media, etc.) is stereophonic. The playing device therefore needs to "mix" the two channels (originally left and right) into one, prior to the signal reaching the loudspeaker. The disclosed embodiments provide techniques to achieve that "mix" without losing vital information and signal energy. Thus, in some embodiments, the disclosed audio processing apparatus may be embodied in a mobile phone or other mobile communication and/or computing device.

It will thus be appreciated that the embodiments described above are cited by way of example, and that the present invention is not limited to what has been particularly shown and described hereinabove. Rather, the scope of the present invention includes both combinations and sub-combinations of the various features described hereinabove, as well as variations and modifications thereof which would occur to persons skilled in the art upon reading the foregoing description and which are not disclosed in the prior art. Documents incorporated by reference in the present patent application are to be considered an integral part of the application except that to the extent any terms are defined in these incorporated documents in a manner that conflicts with the definitions made explicitly or implicitly in the present specification, only the definitions in the present specification should be considered.

The invention claimed is:

1. An audio processing apparatus, comprising:

an interface configured to receive audio channels comprising respective audio signals;

a control processor, which is configured to generate from the audio signals a control signal as a function of a ratio of an output signal amplitude of the control processor to an amplitude of one of the audio signals, wherein the ratio is indicative of a phase difference between the audio signals;

an adjustment processor, which is configured to calculate, based on the control signal, an adjusting parameter to an amplitude of at least one of the audio signals;

channel modifiers, which are configured to, using the adjusting parameter, adjust the audio signals in the respective audio channels; and a channel combiner, which is configured to sum the audio channels after at least one channel has been adjusted, and output the summed audio channel to a user.

2. The apparatus according to claim 1, wherein the ratio is time-dependent.

3. The apparatus according to claim 1, wherein the audio signals, the control signal, and the adjusting parameter are all time-dependent.

4. The apparatus according to claim 1, wherein the audio channels are mono channels.

5. The apparatus according to claim 1, wherein at least one of the audio channels is a stereo channel.

6. The apparatus according to claim 1, wherein the channel modifiers comprise scalar multipliers.

7. An audio processing apparatus, comprising:

an interface configured to receive audio channels comprising respective audio signals;

a control processor, which is configured to generate a correlation coefficient between the audio signals, by cross-correlating the audio signals;

an adjustment processor, which is configured to calculate, based on the correlation coefficient, an adjusting parameter to an amplitude of at least one of the audio signals;

channel modifiers, which are configured to, using the adjusting parameter, adjust the audio signals in the respective audio channels; and a channel combiner, which is configured to sum the audio channels after at least one channel has been adjusted, and output the summed audio channel to a user.

8. The apparatus according to claim 7, wherein the control processor is configured to assign the correlation coefficient values that vary between +1 and 0.

9. The apparatus according to claim 7, wherein the control processor is configured to assign the correlation coefficient values of +1 or −1.

10. An audio processing apparatus comprising:

an interface configured to receive audio channels comprising respective audio signals;

a control processor, which is configured to generate a control signal from the audio signals;

an adjustment processor, which is configured to calculate, based on the control signal, an adjusting parameter to an amplitude of at least one of the audio signals;

channel modifiers, which are configured to, using the adjusting parameter, adjust the audio signals in the respective audio channels;

a channel combiner, which is configured to sum the audio channels after at least one channel has been adjusted, and output the summed audio channel to a user; and a multi-band crossover, which is configured to split the audio signals of each of the audio channels into spectral bands, and to provide one or more pairs of respective spectral bands having same frequencies to the control processor for generating a respective control signal for each of the pairs.

11. A method, comprising:

receiving audio channels comprising respective audio signals;

generating from the audio signals a control signal as a function of a ratio of an output signal amplitude to an amplitude of one of the audio signals, wherein the ratio is indicative of a phase difference between the audio signals;

calculating, based on the control signal, an adjusting parameter to an amplitude of at least one of the audio signals;

using the adjusting parameter, adjusting the audio signals in the respective audio channels; and summing the audio channels after at least one channel has been adjusted, and outputting the summed audio channel to a user.

12. The method according to claim 11, wherein the ratio is time-dependent.

13. The method according to claim 11, wherein the audio signals, the control signal, and the adjusting parameter are all time-dependent.

14. The method according to claim 11, wherein the audio channels are mono channels.

15. The method according to claim 11, wherein at least one of the audio channels is a stereo channel.

16. The method according to claim 11, wherein adjusting the audio signals comprises multiplying the audio signals with a scalar.

17. A method, comprising:

receiving audio channels comprising respective audio signals;

generating a correlation coefficient between the audio signals by cross-correlating the audio signals;

calculating, based on the correlation coefficient, an adjusting parameter to an amplitude of at least one of the audio signals;

using the adjusting parameter, adjusting the audio signals in the respective audio channels; and summing the audio channels after at least one channel has been adjusted, and outputting the summed audio channel to a user.

18. The method according to claim 17, wherein the correlation coefficient varies between +1 and 0.

19. The method according to claim 17, wherein the correlation coefficient is +1 or −1.

20. A method, comprising:

receiving audio channels comprising respective audio signals;

generating a control signal from the audio signals;

calculating, based on the control signal, an adjusting parameter to an amplitude of at least one of the audio signals;

using the adjusting parameter, adjusting the audio signals in the respective audio channels;

summing the audio channels after at least one channel has been adjusted, and outputting the summed audio channel to a user; and splitting the audio signals of each of the audio channels into spectral bands so as to produce one or more pairs of respective spectral bands having same frequencies, wherein generating the control signal comprises generating a respective control signal for each of the pairs.

* * * * *